US008109368B2

(12) United States Patent
Manabe

(10) Patent No.: US 8,109,368 B2
(45) Date of Patent: Feb. 7, 2012

(54) ELEVATOR DISASTER RESCUE OPERATION SYSTEM

(75) Inventor: Yoshiaki Manabe, Tokyo (JP)

(73) Assignee: Toshiba Elevator Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/014,361

(22) Filed: Jan. 26, 2011

(65) Prior Publication Data

US 2011/0114424 A1 May 19, 2011

Related U.S. Application Data

(63) Continuation of application No. PCT/JP2010/067962, filed on Oct. 13, 2010.

(30) Foreign Application Priority Data

Oct. 19, 2009 (JP) ..... 2009-240516

(51) Int. Cl.
*B66B 1/20* (2006.01)

(52) U.S. Cl. ..... 187/384; 187/392

(58) Field of Classification Search ..... 187/247, 187/248, 313, 316, 317, 380–388, 391–393
See application file for complete search history.

(56) References Cited

U.S. PATENT DOCUMENTS 6,000,505 A * 12/1999 Allen ..... 187/391
7,182,174 B2 * 2/2007 Parrini et al. ..... 182/18
7,461,723 B2 * 12/2008 Kawai ..... 187/313
7,588,126 B2 * 9/2009 Siikonen et al. ..... 187/384
7,594,564 B2 * 9/2009 Siikonen et al. ..... 187/384
7,621,378 B2 11/2009 Kawai
7,637,354 B2 12/2009 Kawai
7,669,695 B2 * 3/2010 Hikita et al. ..... 187/284
7,677,363 B2 3/2010 Kawai
7,743,889 B2 * 6/2010 Kawai ..... 187/313
2005/0173199 A1 8/2005 Kawai
2007/0163845 A1 7/2007 Kawai
2007/0278044 A1 12/2007 Hikita et al.

(Continued)

FOREIGN PATENT DOCUMENTS

JP 2005-187162 A 7/2005

(Continued)

OTHER PUBLICATIONS

U.S. Appl. No. 13/014,369, filed Jan. 26, 2011, Manabe.

(Continued)

*Primary Examiner* — Anthony Salata
(74) *Attorney, Agent, or Firm* — Foley & Lardner LLP

(57) ABSTRACT

According to one embodiment, there is provided an elevator rescue operation system to be used in a building in which a plurality of elevators are installed in parallel. The system includes a disaster detection unit configured to detect, when a disaster has occurred in the building, an occurrence site of the disaster, a zone setting unit configured to set a plurality of zones to which all the elevators are caused to respond on the basis of the disaster occurrence site detected by the disaster detection unit, and a rescue operation unit configured to individually cause an elevator to respond to floors in each zone set by the zone setting unit, the elevator being corresponding to the zone, thereby carrying out a through-car operation up to a refuge floor.

8 Claims, 10 Drawing Sheets

U.S. PATENT DOCUMENTS

| | | | | |
|---|---|---|---|---|
| 2008/0202861 | A1 | 8/2008 | Kawai | |
| 2010/0213011 | A1 * | 8/2010 | Hikita et al. | 187/247 |
| 2010/0224451 | A1 | 9/2010 | Hikita et al. | |

FOREIGN PATENT DOCUMENTS

| | | | |
|---|---|---|---|
| JP | 2007-131362 | A | 5/2007 |
| WO | WO 2004/101418 | A1 | 11/2004 |

OTHER PUBLICATIONS

Y. Manabe, U.S. PTO Office Action, U.S. Appl. No. 13/014,369, dated Apr. 13, 2011, 10 pages.

Y. Manabe, U.S. PTO Final Office Action, U.S. Appl. No. 13/014,369, dated Jul. 25, 2011, 8 pages.

* cited by examiner

ELEVATOR DISASTER RESCUE OPERATION SYSTEM

CROSS REFERENCE TO RELATED APPLICATIONS

This is a Continuation Application of PCT Application No. PCT/JP2010/067962, filed Oct. 13, 2010, which was published under PCT Article 21(2) in Japanese.

This application is based upon and claims the benefit of priority from Japanese Patent Application No. 2009-240516, filed Oct. 19, 2009; the entire contents of which are incorporated herein by reference.

FIELD

Embodiments described herein relate generally to an elevator rescue operation system configured to carry out a rescue operation when a disaster such as a fire or the like occurs in a building by using all of elevators.

BACKGROUND

Concomitantly with the Manhattanization of buildings in recent years, elevators play an indispensable role as vertical transportation means of a building. Further, an elevator plays an important role in order that a disabled person such as a wheelchair user may move between floors.

Here, in case of fire, presently, an operation in which an elevator is shifted to a refuge floor, thereafter the operation of the elevator is stopped is to be carried out. That is, in the existing circumstances, elevators are not positively utilized as evacuation means. However, it is a hard labor to move from an upper floor to a refuge floor (normally ground floor) by using stairs, and the evacuation takes much time.

Thus, in recent years, the demand for positively utilizing elevators as evacuation means at the time of occurrence of a fire is increasing. In, for example, Pat. Document 1, as a method of efficiently evacuating personnel in a building by using elevators, a method of grouping floors to be evacuated, guiding the personnel in the building to the grouped floors, and causing the elevators to respond to the grouped floors is disclosed.

Prior Art Document

Patent Document

Pat. Document 1: Jpn. Pat. Appln. KOKAI Publication No. 2007-131362

DETAILED DESCRIPTION

In general, according to one embodiment, there is provided an elevator rescue operation system to be used in a building in which a plurality of elevators are installed in parallel. The system includes a disaster detection unit configured to detect, when a disaster has occurred in the building, an occurrence site of the disaster, a zone setting unit configured to set a plurality of zones to which all the elevators are caused to respond on the basis of the disaster occurrence site detected by the disaster detection unit, and a rescue operation unit configured to individually cause an elevator to respond to floors in each zone set by the zone setting unit, the elevator being corresponding to the zone, thereby carrying out a through-car operation up to a refuge floor.

Hereinafter, embodiments will be described below with reference to the drawings.

First Embodiment

Figure 1:
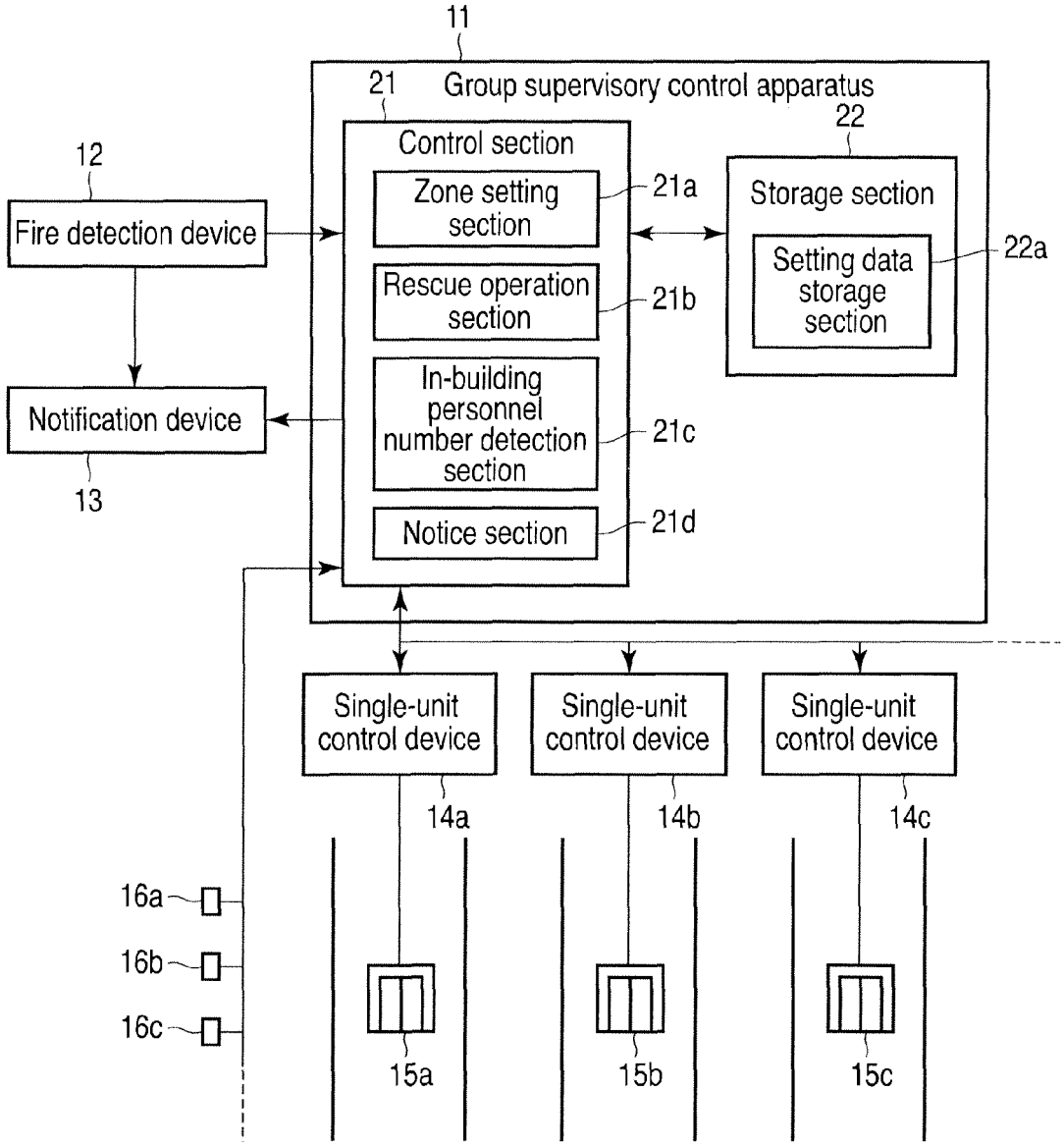
FIG. 1 is a block diagram showing the configuration of an elevator rescue operation system according to a first embodiment.

FIG. 1 is a block diagram showing the configuration of an elevator rescue operation system according to a first embodiment.

This system includes a group supervisory control apparatus 11, fire detection device 12, notification device 13, single-unit control devices 14*a*, 14*b*, 14*c*, . . . , elevator cars 15*a*, 15*b*, 15*c*, , . . . , and hall call buttons 16*a*, 16*b*, 16*c*, . . . .

The group supervisory control apparatus 11 subjects a plurality of elevators installed in a building to group supervisory control. The group supervisory control apparatus 11 is constituted of a computer. The fire detection device 12 is provided on each floor of the building, detects occurrence of a fire and notifies the group supervisory control apparatus 11 of a site of occurrence of the fire. The notification device 13 notifies evacuation warning or the like when occurrence of a fire is detected by the fire detection device 12.

Each of the single-unit control devices 14*a*, 14*b*, 14*c*, . . . is used to individually control an operation of each of the elevators such as registration of a car call, door opening/closing, and the like. The single-unit control devices 14*a*, 14*b*, 14*c*, . . . are also constituted of a computer like the group supervisory control apparatus 11. Each of the cars 15*a*, 15*b*, 15*c*, . . . carries out an ascending/descending operation by the drive of a hoisting device (not shown), and moves between floors while carrying passengers riding therein.

Further, the hall call buttons 16*a*, 16*b*, 16*c*, . . . are provided at elevator halls (elevator loading zones) of the floors. By the operation of each of the hall call buttons 16*a*, 16*b*, 16*c*, . . . , a hall call signal including information indicating the floor of the hall and destination direction is transmitted to the group supervisory control apparatus 11. As a result of this, the group supervisory control apparatus 11 selects an elevator to which the hall call is to be assigned on the basis of the operational state of each elevator, and causes the selected elevator to respond to the hall call.

Here, in this embodiment, the group supervisory control apparatus 11 is provided with a control section 21 and storage section 22.

The control section 21 is configured to carry out processing associated with operation control of each elevator, and here the control section 21 includes a zone setting section 21*a*, rescue operation section 21*b*, in-building personnel number detection section 21*c*, and notice section 21*d*.

The zone setting section 21*a* sets a plurality of zones to which the elevators are caused to respond on the basis of a fire occurrence site detected by the fire detection device 12. Further, the zone setting section 21*a* has a function of dynamically changing the currently set setting contents of each zone in accordance with the transportation state of in-building personnel of each zone.

The rescue operation section 21*b* individually causes an elevator corresponding to a zone in question to respond to each floor in each zone set by the zone setting section 21*a*, thereby carrying out a through-car operation up to the refuge floor. The in-building personnel number detection section 21*c* notifies the inside of the car or the hall that a rescue operation is being carried out concomitantly with the rescue operation carried out by the rescue operation section 21*b*.

The storage section 22 stores therein various information items necessary for operation control of the control section 21. The storage section 22 is provided with a setting data storage section 22*a*. In the setting data storage section 22*a*, the number of floors of each zone, and data associated with the responding elevators set by the zone setting section 21*a* are stored.

Figure 2:
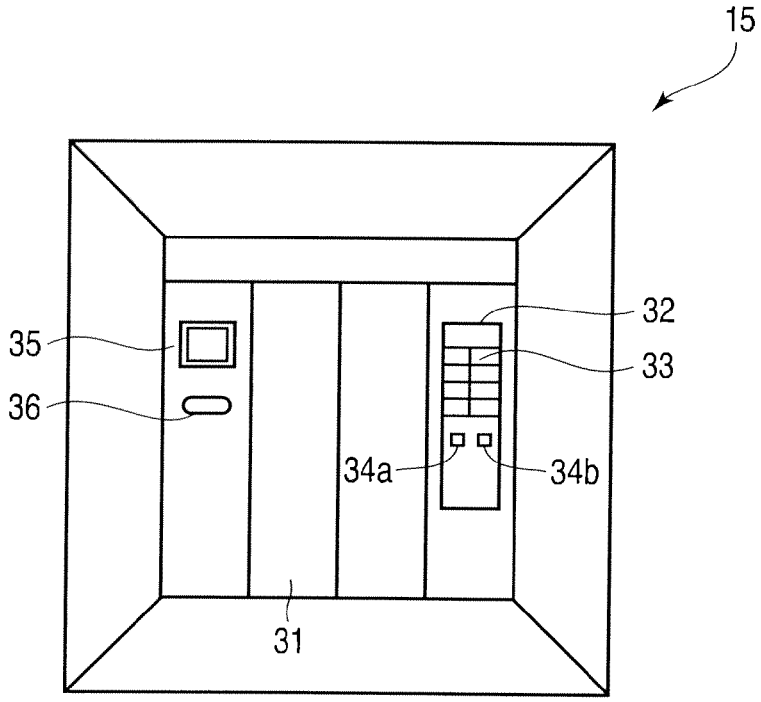
FIG. 2 is a view showing the configuration of an elevator car in the first embodiment.

FIG. 2 is a view showing the configuration of an elevator car.

A car door 31 is openably/closably provided in front of the car 15, and an operation panel 32 on which various operation buttons are arranged is provided at a position beside the car door 31. Destination floor designation buttons 33 used by passengers to designate destination floors, door-opening button 34*a*, door-closing button 34*b*, and the like are provided on the operation panel 32.

Further, a display device 35 configured to display a message, and speaker 36 configured to carry out voice announcement are provided in the car 15.

Figure 3:
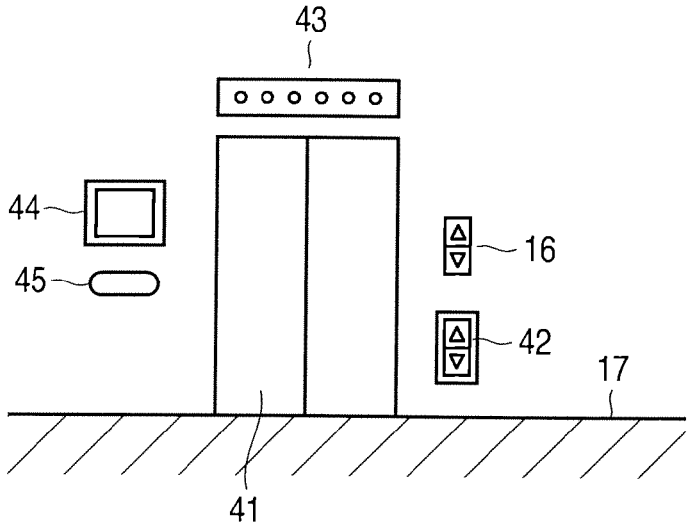
FIG. 3 is a view showing the configuration of an elevator hall.

FIG. 3 is a view showing the configuration of the elevator hall.

The elevator hall 17 is openably/closably provided with a hall door 41. The hall 41 door opens/closes in liaison with the car door 31 when the car 15 arrives at the floor. The hall call buttons 16 are provided in the vicinity of the hall door 41.

The hall call buttons 16 are operation buttons used to register a hall call and, more specifically, are constituted of an upward direction designation button and downward direction designation button used to designate destination directions. Hall call buttons 42 exclusively used for wheelchair users are provided separately from the hall call buttons 16. The hall call buttons 42 are arranged at such a height that they can be operated by a person in a wheelchair.

Further, an indicator 43 configured to display a current car position or the like is provided above the hall door 41. Furthermore, a display device 44 used to display a message, and speaker 45 used to carry out voice announcement are provided near the hall door 41.

Next, an operation of this system will be described below.

Figure 4:
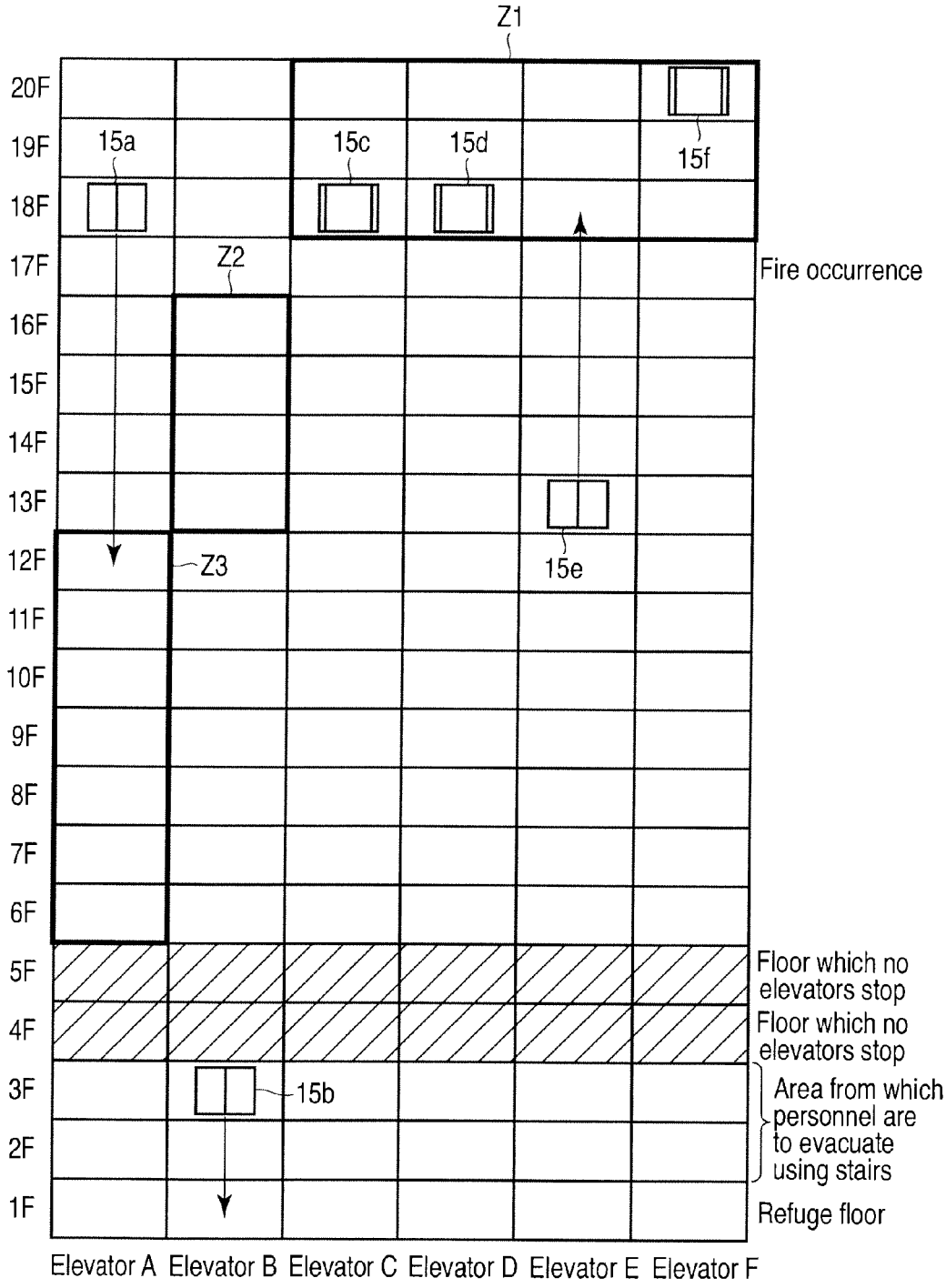
FIG. 4 is a view showing a zone setting state at the rescue operation time in the first embodiment.

Now, a system in which six elevators are provided in parallel in a building of 1st to 20th floors as shown in FIG. 4 is assumed. It should be noted that it is assumed that the 4th floor and 5th floor are set as way floors (floors for which no elevator does not stop). Further, the 2nd floor and 3rd floor are set as areas from which personnel therein are to evacuate by using stairs, and 1st floor is set as a refuge floor at the fire occurrence time. Reference symbols Z1, Z2, and Z3 denote zones to which all the elevators respond at the time of a rescue operation, and the parts surrounded by thick lines indicate the range of the zones.

In the following, the six elevators are respectively called elevator A, elevator B, elevator C, elevator D, elevator E, and elevator F, and cars of these elevators are described as the cars 15*a*, 15*b*, 15*c*, 15*d*, 15*e*, and 15*f*, respectively.

Figure 6:
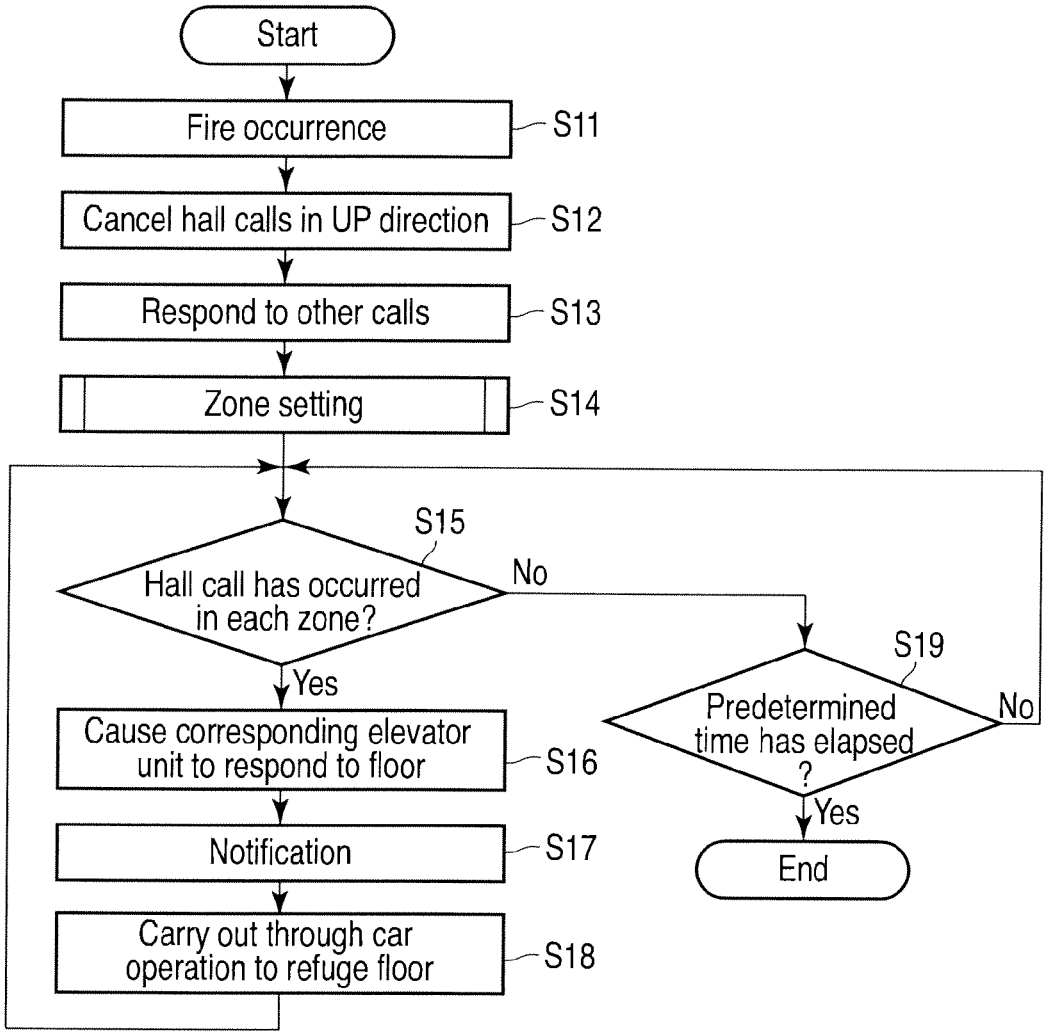
FIG. 6 is a flowchart showing a processing operation of a rescue operation at the time of occurrence of a fire in the first embodiment.

FIG. 6 is a flowchart showing a processing operation of a rescue operation at the time of occurrence of a fire in the first embodiment. It should be noted that the processing shown by this flowchart is executed by the group supervisory control apparatus 11 which is a computer by reading a predetermined program.

When a fire breaks out in a building, the fire occurrence site (floor at which the fire has broken out) is detected by the fire detection device 12, and a detection signal thereof is supplied to the group supervisory control apparatus 11 (step S11). As a result of this, the control section 21 provided in the group supervisory control apparatus 11 switches the mode from the normal operation mode to the rescue operation mode, and firstly cancels all of currently registered hall calls in the UP direction (upward direction), thereby inhibiting in-building personnel from moving in the upward direction (step S12).

Further, the control section 21 causes each elevator to respond to other calls, i.e., hall calls and car calls in the DN (downward) direction (step S13), and thereafter executes the following rescue operation.

It should be noted that the "hall call" implies a signal of a call registered by the operation of one of the hall call buttons 16 provided at the elevator hall of each floor, and information on a registered floor and destination direction is included therein. This hall call signal is supplied to the group supervisory control apparatus 11, then the group supervisory control apparatus 11 selects an optimum elevator from the current operational state, and causes the selected elevator to respond to the floor at which the hall call has been registered.

Conversely, the "car call" implies a signal of a call registered by the operation of one of the destination floor designation buttons 33 provided in the car 15, and information on a destination floor is included therein. This car call signal is supplied to a corresponding one of the single-unit control devices 14*a*, 14*b*, 14*c*, . . . . For example, when a car call signal is supplied to the single-unit control device 14*a*, the single-unit control device 14*a* causes the car 15*a* to move to a destination floor designated by the operation of the destination floor designation button 33.

In the rescue operation mode, the control section 21 sets a plurality of zones to which all the elevators are caused to respond (step S14).

Figure 7:
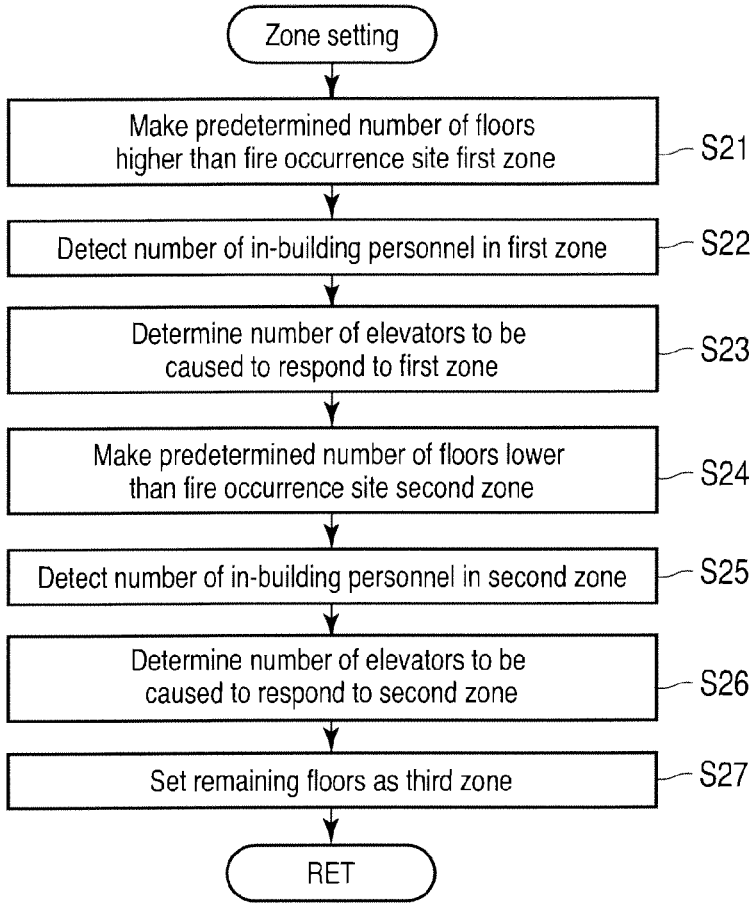
FIG. 7 is a flowchart showing an operation of zone setting processing at the time of occurrence of a fire in the first embodiment.

A flowchart of the zone setting processing is shown in FIG. 7.

Normally, a fire extends in the upward direction, and hence in-building personnel present on floors higher than the fire occurrence site must be rescued with top priority. Thus, the control section 21 makes a predetermined number of floors (for example, three floors) higher than the fire occurrence site a first zone Z1 (step S21). This first zone Z1 is set as a zone to which the highest priority of the rescue operation is to be given.

Subsequently, the control section 21 detects the number of in-building personnel on the floors in the first zone Z1 (step S22). It should be noted that as the method of detecting in-building personnel on the floors, there is, for example, a method in which a camera is provided at a predetermined place of each floor, and the number of in-building personnel present on each floor is detected from an image of the camera.

Further, there is a method or the like in which the number of car-riding personnel and number of car-alighting personnel are recorded for each floor, and the number of in-building personnel currently present on each floor is detected on the basis of the recorded result. The number of car-riding personnel, and number of car-alighting personnel can be estimated from a change in the movable load of the car.

Further, when a security system provided with a function of carrying out personal authentication of personnel entering the building by means of an ID card or the like is installed in the building, the number of in-building personnel on the floors may be acquired from the security system.

Here, the control section 21 determines the number of elevators in such a manner that the transportation capacity in zone Z1 becomes higher than a predetermined level on the basis of the number of in-building personnel in the first zone Z1, and assigns elevators of a number corresponding to the determined number of elevators to the first zone Z1 (step S23).

For example, it is assumed that the number of total in-building personnel in the first zone Z1 is 200, and transportation capacity of one elevator is 50 persons/minute. When the transportation capacity necessary for the first zone Z1 is assumed to be T1, if T1 is 200 persons/minute, 4 elevators are required. It should be noted that the transportation capacity is a value to be set in advance, and in this embodiment, the capacity capable of completing transportation of the in-building personnel in zone Z1 within one minute is regarded as T1.

Then, the control section 21 makes a predetermined number of floors (for example, four floors) lower than the fire occurrence site a second zone Z2 (step S24). This second zone Z2 is set as a zone to which the priority next to the first zone Z1 is to be given.

The control section 21 detects the number of in-building personnel on the floors in the second zone Z2 in the manner identical with that of the first zone Z1 (step S25). Further, the control section 21 determines the number of elevators on the basis of the number of in-building personnel in the second zone Z2, and transportation capacity necessary for zone Z2, and assigns elevators of a number corresponding to the determined number of elevators to the second zone Z2 (step S26). In this case, the transportation capacity necessary for the second zone Z2 is set lower than the first zone Z1. For example, assuming that the transportation capacity necessary for the second zone Z2 is T2, T1 and T2 satisfy the relationship of T1>T2.

It should be noted that when the elevators of a number corresponding to the necessary number cannot be assured because many elevators are assigned to zone Z1, an upper limit value of the assignable number of elevators is set. However, the assignment is carried out in such a manner that one or more elevators are assigned to each zone.

Further, the control section 21 sets the remaining floors excluding the area from which personnel are to evacuate by using stairs as a third zone Z3, and assigns the remaining elevators to the third zone Z3 (step S27).

A specific example is shown in FIG. 4.

For example, it is assumed that a fire has occurred on the 17th floor. In this case, a predetermined number of floors higher than the 17th floor and including the 18th floor are set as the first zone Z1, and the corresponding elevators to be caused to respond to the first zone Z1 are set. In this example, setting is made in such a manner that the first zone Z1 includes the 18th to 20th floors, and elevators C to F are caused to respond to these floors.

Further, regarding the floors lower than the fire occurrence site, the second zone Z2, and third zone Z3 are set from a position closer to the fire occurrence site. In this example, setting is made in such a manner that the second zone Z2 includes the 13th to 16th floors, and elevator B is to respond to these floors. Further, setting is made in such a manner that the third zone Z3 includes the 6th to 12th floors, and elevator A is to respond to these floors. It should be noted that the 2nd and 3rd floors are included in the area from which personnel are to evacuate by using stairs, and are out of the zone setting.

Assuming that the transportation capacity of the first zone Z1 is T1, transportation capacity of the second zone Z2 is T2, and transportation capacity of the third zone Z3 is T3, a relationship of T1>T2>T3 is obtained, and the transportation capacity of the first zone Z1 is set as the highest one. This is because the upper floors are close to the fire occurrence site and are highly dangerous, and hence it is necessary to put the personnel on the upper floors down to the lower floor without a moment's delay.

It should be noted that when many floors are present at positions higher than the first zone Z1, it is also sufficient if zones are set finer in accordance with the number of floors. In this case, zones higher than the fire occurrence site have priority over zones lower than the fire occurrence site, and the priority order is determined in the order of proximity to the fire occurrence site.

Figure 5:
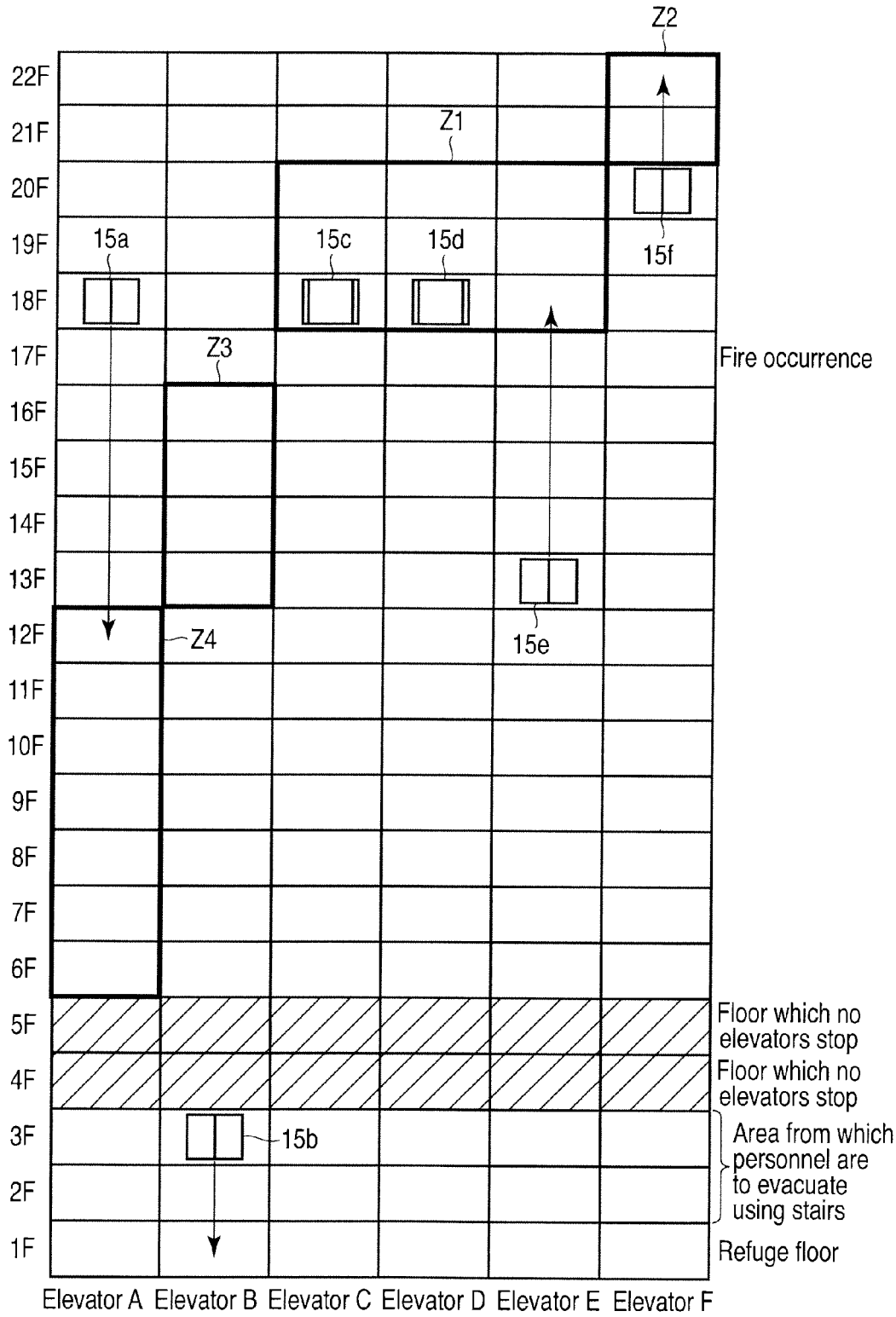
FIG. 5 is a view showing another zone setting state at the rescue operation time.

That is, in the case where 21st and 22nd floors exist above the first zone as in the example of FIG. 5, the 21st and 22nd floors are set as the second zone Z2. Next, the 13th to 16th floors which are floors lower than the fire occurrence site are set as the third zone Z3, and 6th to 12th floors which are floors further lower than the third zone Z3 are set as the fourth zone Z4.

Further, on the basis of the number of in-building personnel in zones Z1 to Z4, and the transportation capacities, the number of elevators to be caused to respond to each of the zones is determined. Assuming that the transportation capacity of the first zone Z1 is T1, transportation capacity of the second zone Z2 is T2, transportation capacity of the third zone Z3 is T3, and transportation capacity of the fourth zone Z4 is T4, there is a relationship of T1>T2>T3>T4 between the transportation capacities.

It should be noted that the 17th floor which is the fire occurrence site is excluded from the objects of response. When a fire breaks out, it is desirable that an announcement that personnel in the building should quickly escape from their places be made through the notification device 13.

Data concerning the number of floors of each zone, and elevators to be caused to respond to the corresponding zones set in this way is stored in the setting data storage section 22*a* of the storage section 22.

Then, returning to FIG. 6, it is determined by the control section 21 whether or not a hall call has occurred in each zone (step S15). When a hall call has occurred, that is, when, in the example of FIG. 4, in-building personnel are present on any floor of each of zones Z1 to Z3, and the hall call button 16 provided on the floor has been depressed (Yes in step S15), the control section 21 refers to the setting data storage section 22*a* of the storage section 22 to select the optimum elevator from the elevators corresponding to the zone in question, and assigns the hall call to the selected elevator to cause the elevator to respond to the floor (step S16).

It should be noted that elevators to which no hall calls are assigned are to be immediately distributed to the zones to be rescued. For example, such elevators are distributed preferentially to floors one by one in the order of proximity to the fire occurrence site.

In the example of FIG. 4, for example, when a hall call occurs on the 19th floor in the first zone Z1, the hall call of the 19th floor is assigned to one of elevators C to F. It should be noted that assignment of the hall call is carried out with respect to each floor in each zone by using the normal assignment evaluation function.

Further, the control section 21 notifies the cars 15 and halls 17 that the elevators are in a rescue operation (step S17). The method of notification may be message display or voice announcement.

Figure 8:
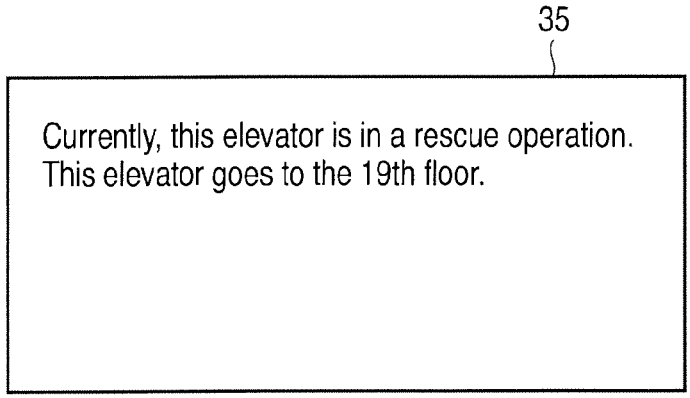
FIG. 8 is a view showing a message display example of a display device provided in an elevator car in the first embodiment.

FIG. 8 is a view showing a message display example of the display device 35 provided in the elevator car 15.

When a corresponding elevator for the rescue operation is caused to respond to the 18th floor which is the priority response floor, a message indicating that, for example, "Currently, this elevator is in a rescue operation. This elevator goes to the 19th floor." is displayed on the display device 35. This makes it possible to prevent in-building personnel from mistakenly riding on the elevator car during the rescue operation. It should be noted that the same message may be simultaneously notified by voice by using the speaker 36.

Figure 9:
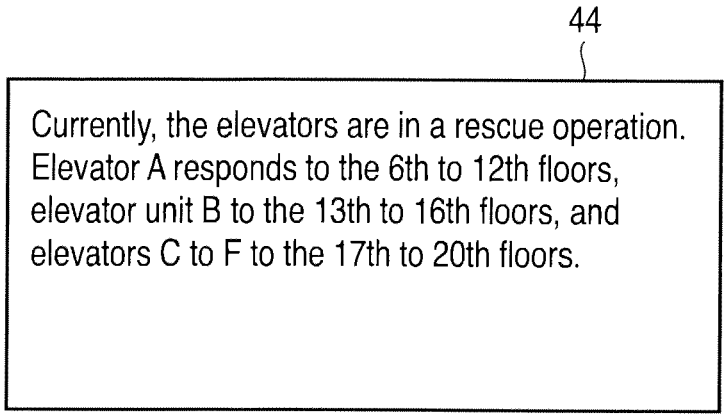
FIG. 9 is a view showing a message display example of a display device provided at an elevator hall in the first embodiment.

FIG. 9 is a view showing a message display example of the display device 44 provided at the elevator hall 17.

When the rescue operation is to be carried out, at the elevator hall on each floor, a message indicating that, for example, "Currently, the elevators are in a rescue operation. Elevator A responds to the 6th to 12th floors, elevator B to the 13th to 16th floors, and elevator C to the 17th to 20th floors." is displayed on the display device 44. This notifies the in-building personnel on each floor which elevator is to respond to the floor, thereby making it possible to ease those personnel.

Further, although the waiting time at each of floors other than the first zone Z1 becomes longer during the rescue operation, by carrying out the notification by the message at the elevator hall of each floor, it is possible to guide the in-building personnel on comparatively safe floors to evacuation using no elevators and using stairs as much as possible. It should be noted that the same message may be simultaneously notified by voice by using the speaker 44.

When the corresponding elevator has responded to the 18th floor which is the priority response floor, and in-building personnel have ridden on the car in the manner described above, the control section 21 automatically registers a car call of the 1st floor which is the refuge floor to start the car, and causes the elevator to carry out a through-car operation toward the 1st floor which is the refuge floor (step S19). In this case, registration of car calls associated with floors other than the refuge floor is to be inhibited. Further, notification indicating that evacuation is to be carried out by using stairs may be given to the elevator halls of the 2nd and 3rd floors which are set as an area from which evacuation is to be done by using stairs.

On the other hand, in each zone, when after occurrence of a hall call, no next hall call is issued after an elapse of a predetermined time (for example, one minute) (Yes in step S19), the control section 21 determines that all the in-building personnel in each zone have evacuated, and terminates the rescue operation here.

As described above, according to this system, at the time of occurrence of a fire, the floors of the building are divided into a plurality of zones by using the fire occurrence site as the point of reference, and all the elevators are individually caused to respond to these zones. This makes it possible to efficiently carry out a rescue operation while holding down the number of stops of the elevators to a minimum, and quickly transport the in-building personnel on each floor to the refuge floor. At that time, if a floor is a floor in the zone, the elevator responds to the floor, and hence it is possible for the in-building personnel on the floor to evacuate by utilizing the elevators without the need to move to another floor.

Further, the transportation capacity of a zone closer to the fire occurrence site is set higher, and hence even when a large number of in-building personnel remain at the fire occurrence site, it is possible to transport the personnel to the refuge floor as quickly as possible.

Second Embodiment

Next, a second embodiment will be described below.

In the first embodiment described above, although the number of floors of each zone and the number of elevators set at the time of occurrence of a fire are fixed, in the second embodiment, zone setting is dynamically changed in accordance with the transportation state of in-building personnel of each zone.

It should be noted that the apparatus configuration of the second embodiment is identical with the first embodiment, and hence here a processing operation will be described below with reference to FIG. 10.

Figure 10:
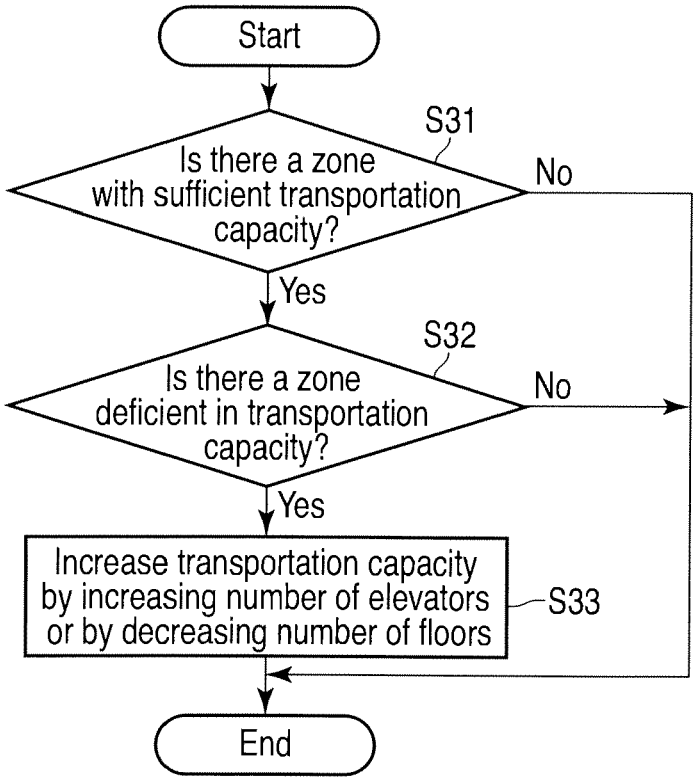
FIG. 10 is a flowchart showing changing processing of zone setting in a second embodiment.

FIG. 10 is a flowchart showing changing processing of zone setting in the second embodiment.

As described in the first embodiment, when a fire breaks out, a plurality of zones are set by using the fire occurrence site as the point of reference, and all the elevators respond to these zones to carry out a rescue operation (see FIG. 5).

Here, when the rescue operation progresses, and a zone having sufficient transportation capacity appears (Yes in step S31), a control section 21 provided in a group supervisory control apparatus 11 checks whether or not there is a zone deficient in transportation capacity (step S32).

It is possible to determine the transportation state of the in-building personnel of each zone from a relationship between the number of currently remaining in-building personnel in each zone, and transportation capacity set in each zone.

A detailed description will be given by paying attention to, for example, the first zone Z1. Assuming the transportation capacity T1 to be 200 persons/minute, when 30 seconds has elapsed from the start of the rescue operation, if the number of in-building personnel in the first zone Z1 is about 100, the transportation is proceeding as previously scheduled.

On the other hand, when 30 seconds has elapsed from the start of the rescue operation, if the number of in-building personnel in the first zone Z1 is about 50 which is a value less than 50% of the expected value, the transportation of the in-building personnel is proceeding faster than previously scheduled. In such a case, it is determined that "the transportation capacity is sufficient". A factor of the fact that the transportation of the in-building personnel is proceeding faster than expected is that each elevator has efficiently repeated the operation in a full capacity state or that some personnel have evacuated by using stairs on the way, or the like.

Further, when 30 seconds has elapsed from the start of the rescue operation, if the number of in-building personnel in the first zone is about 150 which is a value more than 50% of the expected value, the transportation of the in-building personnel is proceeding behind schedule. In such a case, it is determined that "the transportation capacity is insufficient". A factor of the fact that the transportation of the in-building personnel is proceeding behind schedule is that the number of stops of each elevator at floors in the zone is numerous or that in-building personnel have moved to the zone from other zones, or the like.

When a zone having sufficient transportation capacity appears during the rescue operation, and a zone having insufficient transportation capacity is present at that time (Yes in step S32), the control section 21 carries out a setting change with respect to both the zones, and carries out adjustment to increase the transportation capacity by increasing the number of elevators of the zone having insufficient transportation capacity or by decreasing the number of floors of the zone (step S33).

Figure 11:
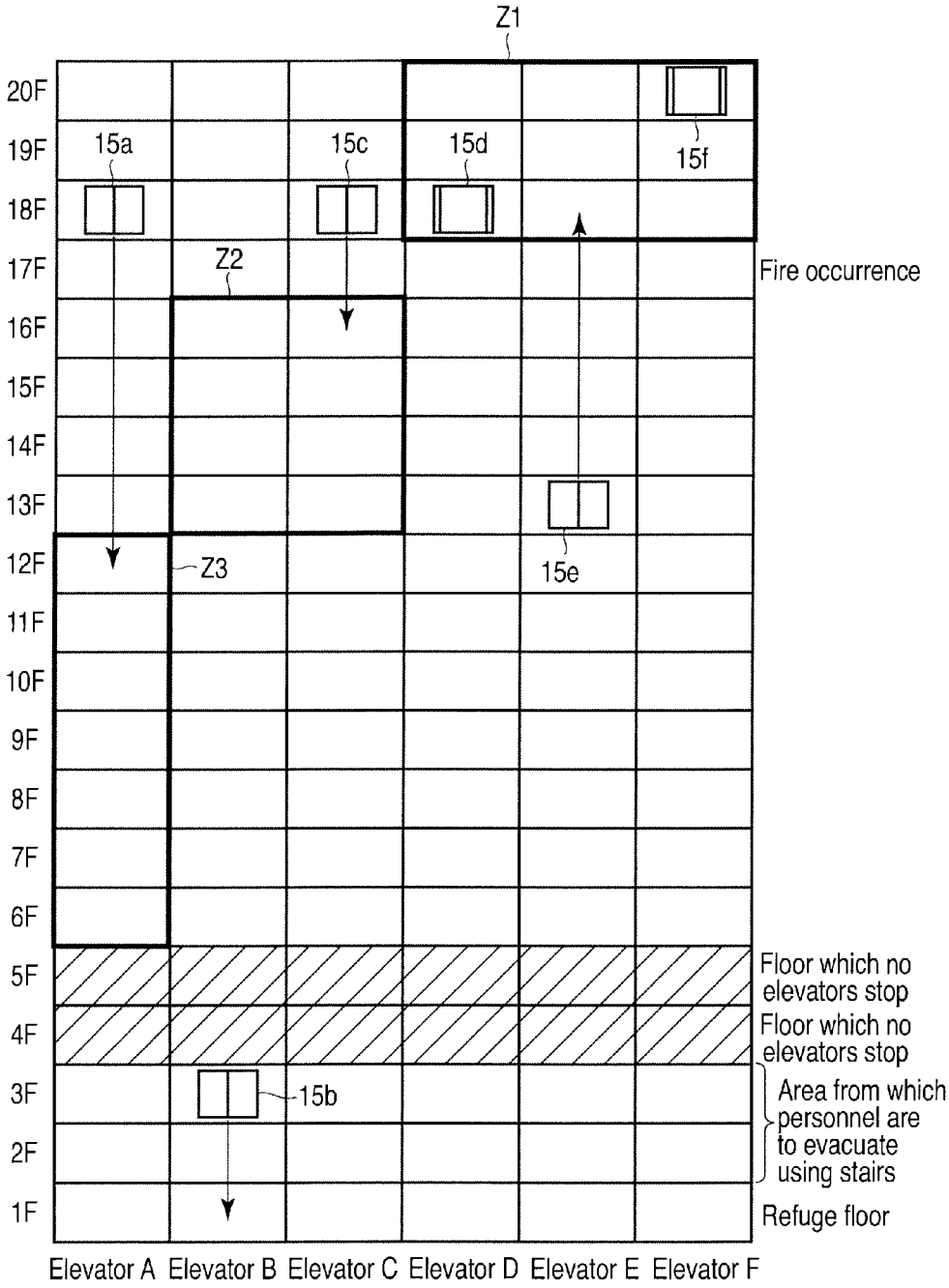
FIG. 11 is a view showing an example of a case where the number of elevators of the second zone is increased as an example of a change in the zone setting in the second embodiment.
Figure 12:
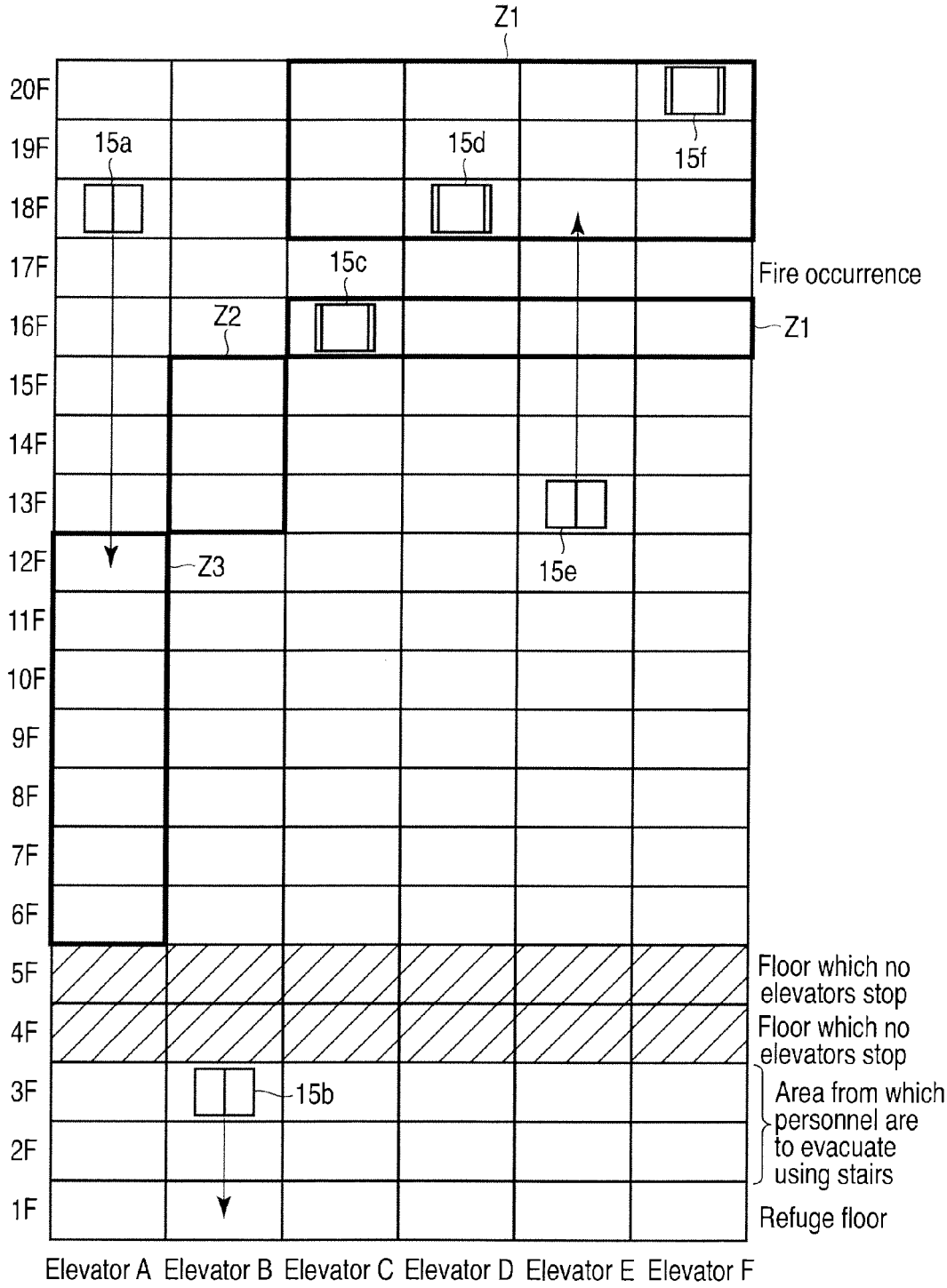
FIG. 12 is a view showing an example of a case where the number of floors of the second zone is decreased as an example of a change in the zone setting in the second embodiment.
Figure 13:
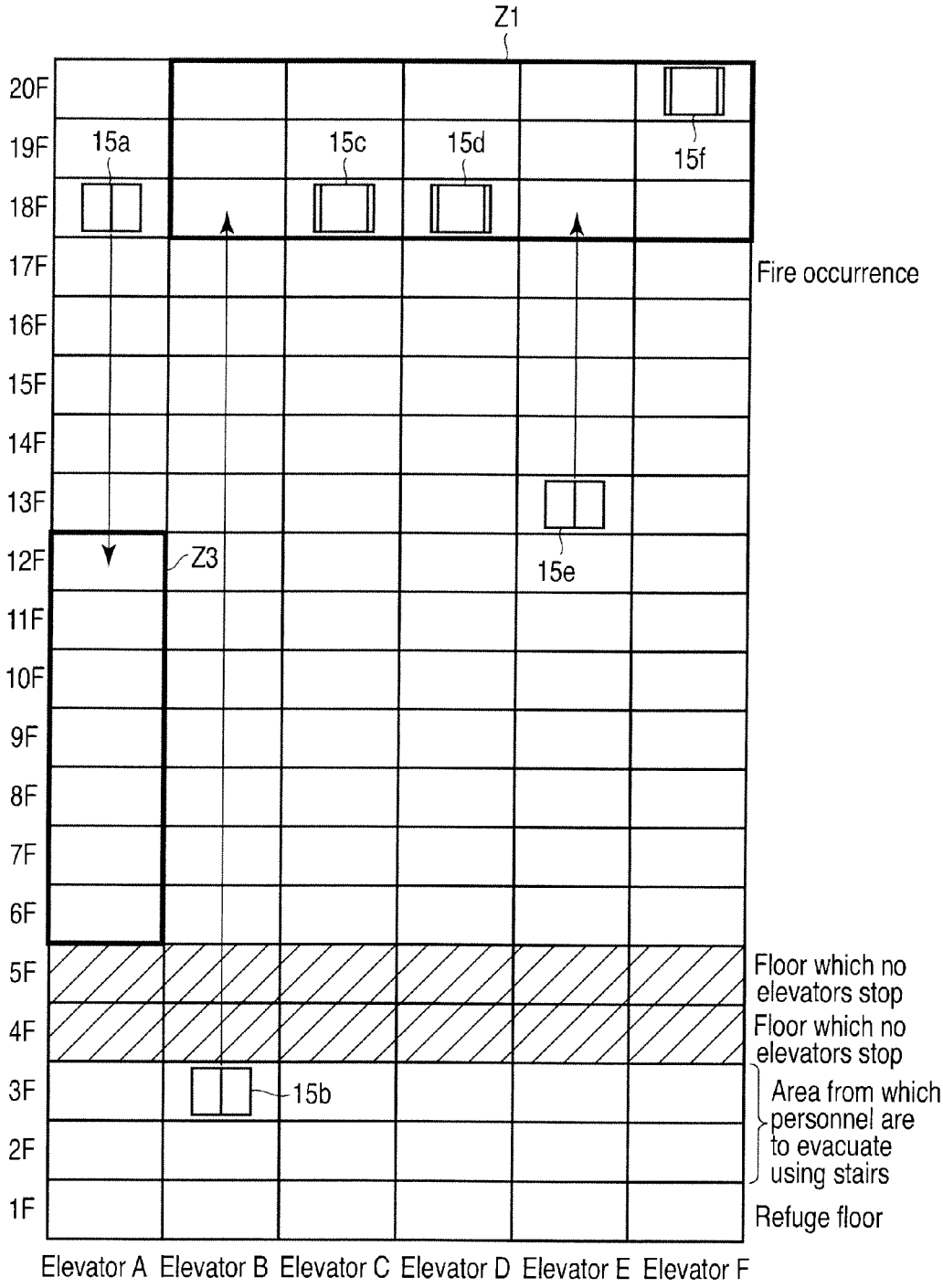
FIG. 13 is a view showing an example of a case where the number of elevators of the first zone is increased as an example of a change in the zone setting in the second embodiment.

Examples of the zone setting change are shown in FIGS. 11 to 13. It should be noted that it is assumed that the state before the setting change, i.e., the state at the fire occurrence time is set as shown in FIG. 4.

The example shown in FIG. 11 is that of a case where the transportation capacity of the first zone Z1 has become sufficient during the rescue operation, whereby setting of one (elevator C in this example) of the four elevators assigned to the first zone Z1 is changed to the second zone Z2. As a result of this, in the second zone Z2, the rescue operation is carried out by two elevators. As a result, it is possible to solve the problem that at the beginning, the transportation capacity of the first zone Z1 which is the highest priority zone has been enhanced, and thus the waiting time in each of other zones has been longer.

The example shown in FIG. 12 is that of a case where the transportation capacity of the first zone Z1 has become sufficient during the rescue operation, whereby setting of one (16th floor in this example) of the four floors set as the second zone Z2 is changed to the first zone Z1. As a result of this, in the second zone Z2, the rescue operation is carried out by using elevator B for the 13th to 15th floors. In this case too, the transportation capacity of the second zone Z2 becomes higher than that at the beginning, and hence it is possible to solve the problem of worsening of the waiting time.

The example shown in FIG. 13 is that of a case where the transportation capacity of the second zone Z2 has become sufficient during the rescue operation, whereby setting of elevator B assigned to the second zone Z2 is changed to the first zone Z1. As a result of this, it is possible to enhance the transportation capacity of the first zone Z1 in which the proceeding of the rescue operation is behind schedule, and transport the in-building personnel to the first floor which is the refuge floor earlier by even a little time.

It should be noted that in the example of FIG. 13, when, in the first zone Z1, the in-building personnel can be transported as expected, elevator B may be made completely free, and may be caused to respond to a call of each floor irrespectively of zone setting.

As described above, zone setting is dynamically changed in accordance with the transportation state of the in-building personnel of each zone, whereby it is possible to carry out the rescue operation more efficiently by using all the elevators, and evacuate the in-building personnel on each floor to a safe place earlier by even a little time.

It should be noted that in the above embodiments, although zone setting is carried out by excluding the floor of the fire occurrence site, zone setting may be carried out by including the floor of the fire occurrence site. In that case, the zone including the fire occurrence floor becomes the highest priority zone (that is, the first zone Z1) of the rescue operation. However, the fire occurrence floor is very dangerous, and hence it is desirable that zone setting be carried out by excluding the floor as in the example of FIG. 4.

Further, in step S19 of FIG. 6, when no hall call occurs after an elapse of a predetermined time from occurrence of a previous hall call in each zone, it is determined that "no in-building personnel are present", and the rescue operation is terminated.

As another method, for example, in each zone, the number of times one of elevators which have responded to hall calls has started without being in a full capacity state may be counted, and when the total value reaches a predetermined number of times (for example, 5 times), it may be determined that "no in-building personnel are present", and the rescue operation may be terminated. It should be noted that "a state close to the full capacity state" is defined as a state where load of the car is about 80% of the rated load determined for the car 15. The movable load of the car 15 is detected by a load sensor (not shown), and it is determined from the detected movable load whether or not the state is close to the full capacity state.

Further, as still another method, in each zone, the time elapsed from the time at which one of elevators which have responded to hall calls has started without being in a full capacity state may be counted, and when the counted time reaches a predetermined time (for example, one minute), it may be determined that "no in-building personnel are present", and the rescue operation may be terminated. When another elevator responds to a hall call during the time counting, the counted value of time is cleared.

Further, in the embodiments described above, although the description has been given assuming the rescue operation in the case of occurrence of a fire, the present invention can also be applied similarly to a case where any disaster other than a fire has occurred in a building.

As has been described above, according to these embodiments, when a fire or the like has occurred, a plurality of zones are set by using the fire occurrence site as the point of reference, and all the elevators individually respond to the floors in these zones. Accordingly, the in-building personnel can quickly evacuate by using the elevators without moving to other floors.

It should be noted that although some embodiments of the present invention have been described above, these embodiments are presented as examples, and are not intended to limit the scope of the invention. These novel embodiments can be implemented in other various forms, and various abbreviations, exchanges, and changes can be made within a scope not deviating from the essence of the invention. These embodiments and their modifications are included in the scope and essence of the invention, and are included in the invention described in the claims, and the equal scope thereof.

Explanation of Reference Symbols

11: Group supervisory control apparatus; 12: Fire detection device; 13: Notification device; 14*a*, 14*b*, 14*c*: Single-unit control device; 15, 15*a*, 15*b*, 15*c*: Elevator car; 16, 16*a*, 16*b*, 16*c*: Hall call button; 21: Control section; 21*a*: Zone setting section; 21*b*: Rescue operation section; 21*c*: In-building personnel number detection section; 21*d*: Notice section; 22: Storage section; 22*a*: Setting data storage section; 31: Car door; 32: Operation panel; 33: Destination floor designation button; 34*a:* Door-opening button; 34*b:* Door-closing button; 35: Display device; 36: Speaker; 41: Hall door; 42: Hall call button; 43: Hall call button for wheelchair users; 43: Indicator; 44: Display device; 45: Speaker While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An elevator rescue operation system to be used in a building in which a plurality of elevators are installed in parallel, comprising:

a disaster detection unit configured to detect, when a disaster has occurred in the building, a disaster occurrence site;

a zone setting unit configured to set a plurality of zones to which all the elevators are caused to respond on a basis of the disaster occurrence site detected by the disaster detection unit; and a rescue operation unit configured to individually cause an elevator to respond to floors in each zone set by the zone setting unit, the elevator being corresponding to the zone, thereby carrying out a through-car operation up to a refuge floor, wherein the zone setting unit dynamically changes the currently set setting contents of each zone in accordance with the transportation state of in-building personnel of each zone.

2. The elevator rescue operation system according to claim 1, wherein the zone setting unit sets a predetermined number of floors including floors higher than the disaster occurrence site detected by the disaster detection unit as the highest priority zone, and determines the number of elevators in such a manner that the capacity of transportation of in-building personnel in the zone becomes higher than or equal to a certain level.

3. The elevator rescue operation system according to claim 1, wherein the zone setting unit sets a plurality of zones to which all the elevators are caused to respond on the basis of the disaster occurrence site detected by the disaster detection unit, detects the number of in-building personnel in each of these zones, and determines the number of elevators to be caused to respond to each of the zones on the basis of the number of in-building personnel, and the transportation capacity set in advance for each of the zones.

4. The elevator rescue operation system according to claim 3, wherein the transportation capacity of in-building personnel for each of the zones is determined in such a manner that the closer a zone is to the disaster occurrence site, the higher the transportation capacity is set for the zone.

5. The elevator rescue operation system according to claim 1, wherein when there is a zone in which transportation of the in-building personnel is proceeding faster than previously scheduled, the zone setting unit checks presence/absence of a zone in which transportation of the in-building personnel is proceeding behind schedule, and if a corresponding zone is present, changes the setting of the number of elevators or the number of floors of each of both the zones to increase the transportation capacity of the latter zone.

6. The elevator rescue operation system according to claim 1, further comprising a notification unit configured to notify the inside of a car of each elevator that the elevator is in a rescue operation concomitantly with the rescue operation carried out by the rescue operation unit.

7. The elevator rescue operation system according to claim 1, further comprising a notification unit configured to notify an elevator hall of each floor that the elevators are in a rescue operation concomitantly with the rescue operation carried out by the rescue operation unit.

8. The elevator rescue operation system according to claim 1, wherein when a fire has broken out in the building, the disaster detection unit detects an occurrence site of the fire.

* * * * *